US005740566A

United States Patent [19]

Stacy

[11] Patent Number: 5,740,566

[45] Date of Patent: Apr. 21, 1998

[54] COMBINATION TARPAULIN-BLANKET CONSTRUCTION

[76] Inventor: Murray Stacy, 5418 Woodville, Spring, Tex. 77379

[21] Appl. No.: 722,772

[22] Filed: Sep. 27, 1996

[51] Int. Cl.[6] ..... A47G 9/06

[52] U.S. Cl. ..... 5/420; 5/417; 224/156; 52/4

[58] Field of Search ..... 5/417–420; 224/156; 52/4

[56] References Cited

U.S. PATENT DOCUMENTS

| | | | |
|---|---|---|---|
| 1,237,243 | 8/1917 | Conner | 5/420 |
| 2,264,471 | 12/1941 | Glenn | 5/420 |
| 4,278,719 | 7/1981 | Sarnecki | 5/420 |
| 4,295,235 | 10/1981 | Deitz | 5/490 |
| 4,703,528 | 11/1987 | Rolle | 5/417 |
| 4,885,812 | 12/1989 | Lindner | 224/156 |
| 4,951,333 | 8/1990 | Kaiser et al. | 5/417 |
| 5,386,603 | 2/1995 | Drust | 5/417 |
| 5,404,600 | 4/1995 | DeMars | 5/420 |
| 5,414,881 | 5/1995 | Terrazas | 5/417 |

*Primary Examiner*—Alexander Grosz
*Attorney, Agent, or Firm*—Larson & Taylor

[57] ABSTRACT

A combination tarpaulin-blanket construction comprises a first, tarpaulin layer of a material such as a cotton canvas, a cotton duck or a cellulose acetate synthetic yarn, and a protective covering of a waterproof and windproof laminated plastic, and a second, blanket layer of a material such as synthetic fleece or wool. The second layer is sewn to a major surface of the first layer to form a tarpaulin-blanket unit of a rectangular shape. Grommets are provided at each corner of the tarpaulin-blanket unit for enabling the unit to be secured in place. Securing straps, affixed to one edge of the tarpaulin-blanket unit, encircle the unit, when the unit is in a rolled-up state, so as to retain the unit in that state. A carrying handle, secured to the one edge between the straps, enables carrying of the unit in the rolled-up state.

17 Claims, 2 Drawing Sheets

COMBINATION TARPAULIN-BLANKET CONSTRUCTION

FIELD OF THE INVENTION

The present invention relates to a combination tarpaulin-blanket construction one side of which provides waterproofing and windproofing protection and the other side of which forms a soft, warm lining.

BACKGROUND OF THE INVENTION

A number of different coverings, blankets, towels and the like have been developed which provide waterproof protection. For example, U.S. Pat. No. 5,414,881 to Terrazas discloses an article which has a waterproof top layer and flannel bottom layer and which combines the functions of a stadium blanket, rain covering and, when folded up, seat cushion. The article can be rolled up for carrying and includes a carrying handle. U.S. Pat. No. 5,386,603 to Drust discloses an oval-shaped waterproof blanket which has a first layer of water proof material and a second layer of a material such as flannel. The blanket can be folded and rolled for transport using a carrying strap and adhesive belts maintain the blanket in the rolled configuration. U.S. Pat. No. 2,264,471 to Glenn discloses a beach blanket with a base layer of canvas and a top layer of towel material. U.S. Pat. No. 4,278,719 to Sarnecki discloses a towel construction including a cover sheet of terrycloth and a backing sheet of waterproof nylon. Other patents of background interest include U.S. Pat. No. 4,295,235 to Deitz relating to a waterproof cushion for outdoor use and U.S. Pat. No. 1,237,243 to Conner relating to an outdoor rug with a carrying strap arrangement.

SUMMARY OF THE INVENTION

In accordance with the invention, a blanket-tarpaulin construction is provided which serves as a true tarpaulin in addition to providing a soft, warm lining. Owing to the materials used therein, the blanket-tarpaulin of the invention is both rugged in construction and attractive in appearance while, at the same time, is relatively inexpensive to manufacture. In addition, a novel carrying arrangement permits easy transport and ready storage.

In accordance with a preferred embodiment, a combination tarpaulin-blanket construction is provided which comprises: a first, tarpaulin layer of a material selected from the group consisting of a cotton canvas, a cotton duck and a cellulose acetate synthetic yarn, and a protective covering of a waterproof and windproof laminated plastic, a second, blanket layer of a material selected from the group consisting of synthetic fleece and wool, sewn to a major surface of the first layer to form a tarpaulin-blanket unit of a rectangular shape, a grommet at each of the corners of the tarpaulin-blanket unit for enabling the unit to be secured in place; securing straps, affixed to one edge of the tarpaulin-blanket unit, for encircling the unit, when the unit is in a rolled-up state, so as to retain the unit in that rolled-up state; and a carrying handle, secured to the one edge of the unit between the straps, for enabling carrying of the unit in the rolled-up state thereof.

The securing straps preferably comprise free ends of an elongate element having a central portion secured to the one edge. Advantageously, the elongate element comprises a length of a synthetic webbing. The carrying handle is preferably fabricated from a synthetic webbing as well.

In a preferred implementation, each of the securing straps has a free end and a base portion, and includes releasable securing means for releasably securing the free end of said strap to an area on the unit at least close to the base portion. The fastening means advantageously comprises snap-lock fastener arrangement comprising a first fastener element disposed at said free end and a second fastener element disposed at said area. Preferably, the straps each include adjustment means for adjusting the length thereof. The carrying handle also preferably includes adjustment means for adjusting the length thereof.

Other features and advantages of the invention will be set forth in, or apparent from, the following detailed description of the preferred embodiment of the invention.

DESCRIPTION OF THE PREFERRED EMBODIMENTS

Figure 1:
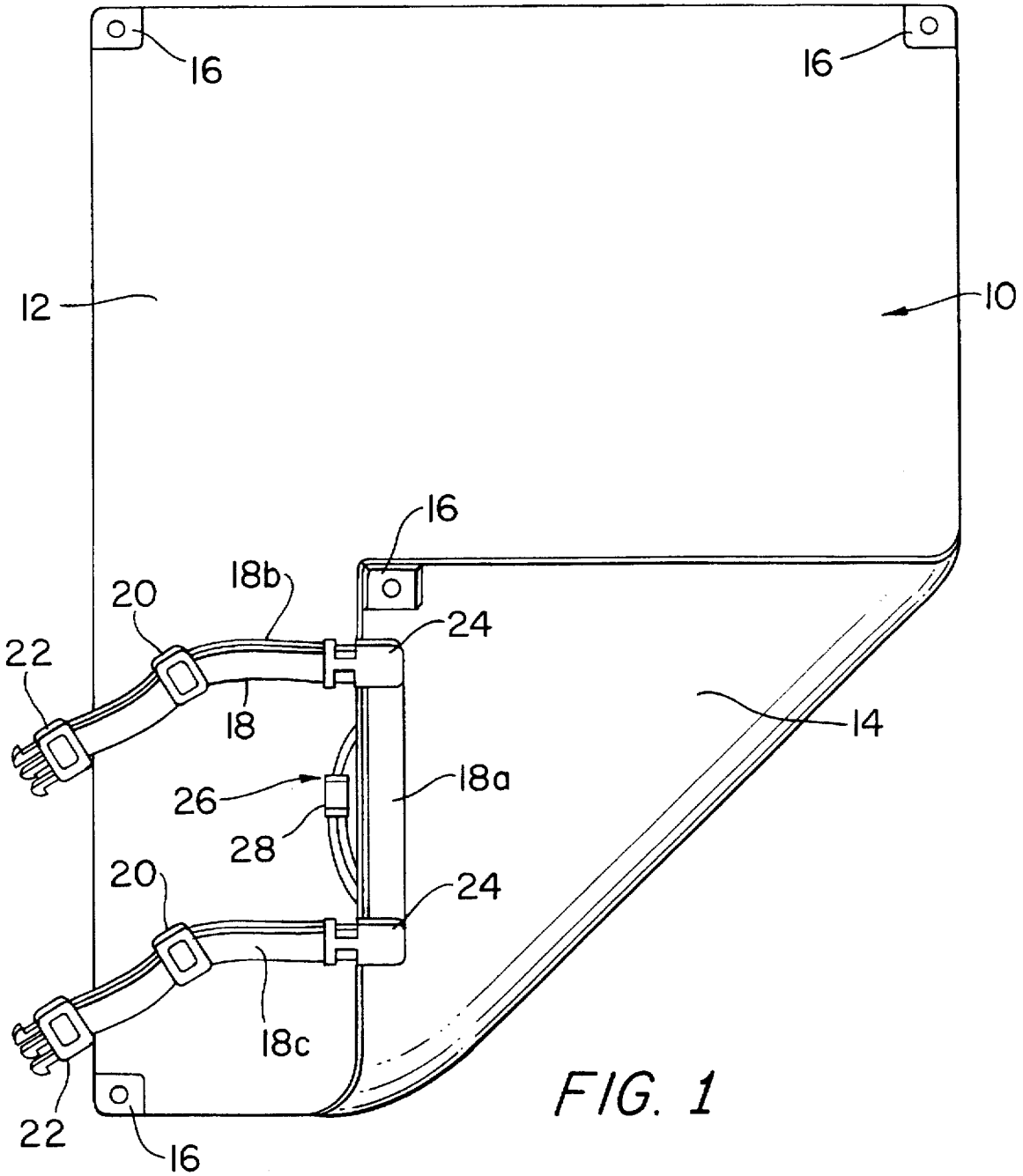
FIG. 1 is a plan view of the tarpaulin-blanket construction of the invention in the unfolded state, with one corner folded back to show the other side of the construction.
Figure 2:
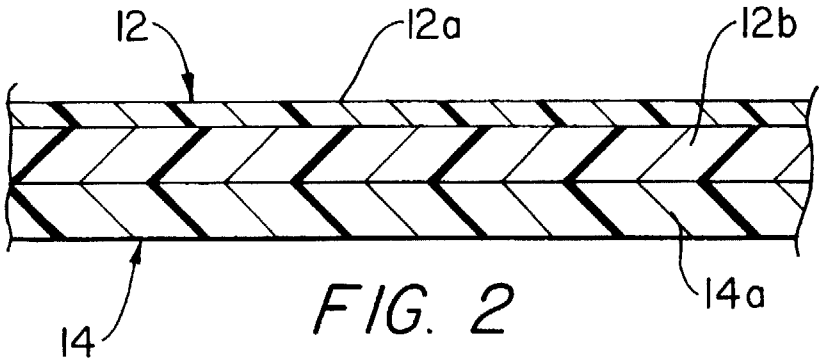
FIG. 2 is a cross section of a portion of the construction of FIG. 1 showing the multiple layers.

Referring to FIG. 1, a preferred embodiment of the combination blanket-tarpaulin construction of the invention is shown. The construction, which is generally denoted 10 and is preferably of a rectangular shape, includes a first "tarp" side 12 which consists of either a heavy cotton canvas, a CORDURA™ nylon (CORDURA being the Dupont trademark for a cellulose acetate synthetic fiber), or a treated, i.e., waxed or oiled, cotton duck, covered with, a laminated waterproof and windproof membrane or outer coating such as a plastic laminate of polyurethane or the like. The other "blanket" side 14 (which is visible by virtue of the folded over corner of blanket construction 10) consists of a synthetic fleece layer or a wool layer sewn to the tarp side 12 to form a soft, warm lining. These various layers are illustrated in FIG. 2 wherein the outer protective coating or membrane is indicated at 12*a*, the tarpaulin material at 12*b* and the blanket material at 14*a*.

Brass grommets 16 are provided at the four corners of construction 10 to facilitate the use thereof as a tarpaulin with tie-downs.

A carrying arrangement includes a strap assembly 18 comprising a strip or length of synthetic webbing including a midportion 18*a* sewn or otherwise affixed along an edge of the construction 10 and a pair of straps 18*b* and 18*c*. Straps 18*b* and 18*c* are preferably adjustable in length, and adjustment slides are indicated at 20. Fastener elements 22 of a conventional snap-lock arrangement are provided at the free ends of straps 18*b* and 18*c* and corresponding mating or interlocking fastener elements 24 are provided at or near the base of straps 18*b* and 18*c* so the straps can be looped around the tarp-blanket construction 10 when rolled up and then fastened by fastener elements 22 and 24 as is described in more detail below. As is schematically shown in FIG. 1, fastener elements 22 include flexible fingers which are received as a snap-lock fit in receptacles formed by fasteners 24. Although this type of connector is advantageous, other suitable connecting or securing devices can be used for this purpose.

A carrying handle 26 is also affixed to the same edge of tarp-blanket 10 between straps 18*b* and 18*c*. Handle 26 is preferably made of the same synthetic webbing material as straps 18*b* and 18*c* and is adjustable in size using an adjustment slide 28.

Figure 3:
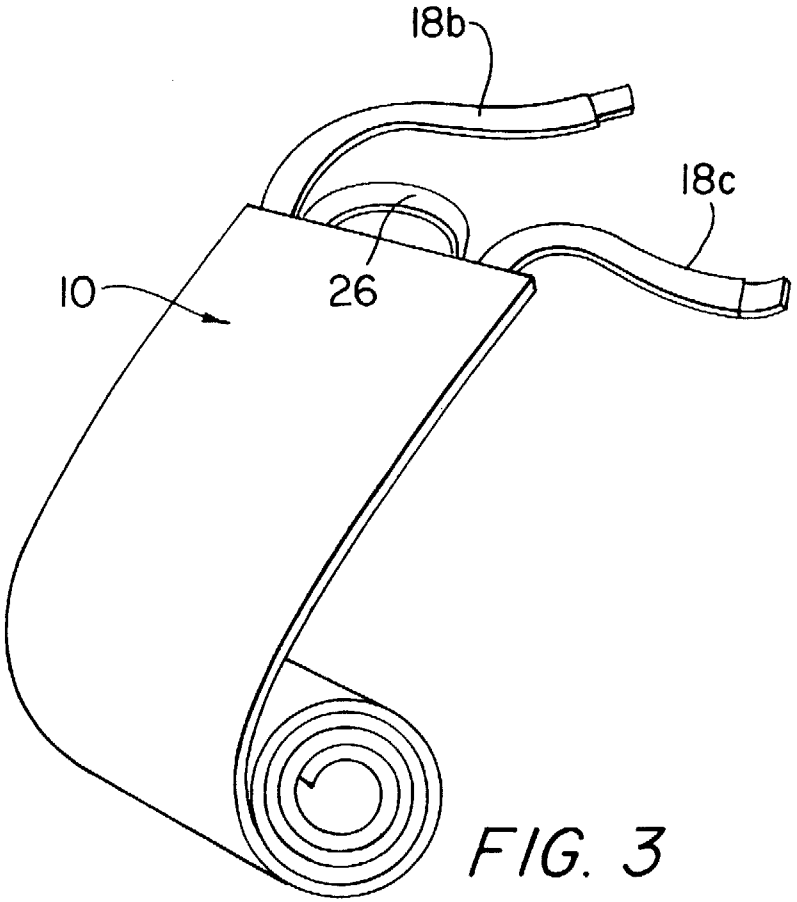
FIG. 3 is a perspective view showing a step in rolling up the tarpaulin-blanket construction of FIG. 1 for carrying and storage.
Figure 4:
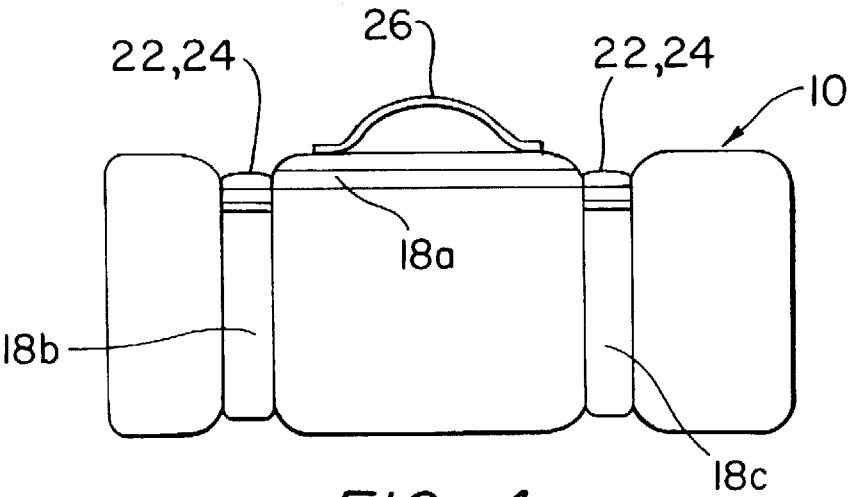
FIG. 4 is a front elevational view of the construction of FIG. 1 in the rolled-up and secured state thereof.

Referring to FIG. 3, the blanket-tarpaulin construction 10 of FIGS. 1 and 2 is shown being rolled up for carrying and storage. To accomplish this, the construction 18 is first folded in half along a central fold line extending orthogonally to the edge at which handle 26 and strap assembly 18 are attached, and then rolled up so that straps 18*b* and 18*c* can be looped around the roll so formed and the associated fastener elements 22 and 24 secured to one another. This rolled-up state is illustrated in FIG. 4, with straps 18*b* and 18*c* encircling the roll and fastener elements 22, 24 interlocked to secure the straps 18*b* and 18*c* in place.

Although the present invention has been described to specific exemplary embodiments thereof, it will be understood by those skilled in the art that variations and modifications can be effected in these exemplary embodiments without departing from the scope and spirit of the invention.

What is claimed is:

1. A combination tarpaulin-blanket construction comprising:

a first, tarpaulin layer of a material selected from the group consisting of a cotton canvas, a cotton duck and a cellulose acetate synthetic yarn, said first layer covered by a protective covering of a waterproof and windproof laminated plastic, a second, blanket layer of a material selected from the group consisting of synthetic fleece and a wool, said second layer being sewn to a major surface of the first layer to form a tarpaulin-blanket unit of a rectangular shape having corners, a grommet at each of the corners of said tarpaulin-blanket unit for enabling the unit to be secured in place;

securing straps, affixed to one edge of said tarpaulin-blanket unit, for encircling the unit, when the unit is in a rolled-up state, so as to retain the unit in said rolled up state, said securing straps comprising free ends of an elongate element having a central portion secured to said one edge, and said elongate element comprising a length of a synthetic webbing; and a carrying handle, secured to said one edge of said unit between said straps, for enabling carrying of the unit in said rolled-up state.

2. A combination tarpaulin-blanket construction as claimed in claim 1 wherein said carrying handle is fabricated from a synthetic webbing.

3. A combination tarpaulin-blanket construction as claimed in claim 1 wherein each of said securing straps has a free end and a base portion, and includes releasable securing means for releasably securing the free end of said strap to an area on said unit at least close to said base portion.

4. A combination tarpaulin-blanket construction as claimed in claim 3 wherein said fastening means comprises snap-lock fastener arrangement comprising a first fastener element disposed at said free end and a second fastener element disposed at said area.

5. A combination tarpaulin-blanket construction as claimed in claim 4 wherein said straps each include adjustment means for adjusting the length thereof.

6. A combination tarpaulin-blanket construction as claimed in claim 5 wherein said carrying handle includes adjustment means for adjusting the length thereof.

7. A combination tarpaulin-blanket construction as claimed in claim 1 wherein said tarpaulin layer material comprises a cellulose acetate synthetic yarn and said second layer comprises a synthetic fleece.

8. A combination tarpaulin-blanket construction as claimed in claim 1 wherein said tarpaulin layer material comprises a cotton canvas and said second layer comprises a synthetic fleece.

9. A combination tarpaulin-blanket construction comprising:

a first, tarpaulin layer of a material selected from the group consisting of a cotton canvas, a cotton duck and a cellulose acetate synthetic yarn, said first layer covered by a protective covering of a waterproof and windproof laminated plastic, a second, blanket layer of synthetic fleece, said second layer being sewn to a major surface of the first layer to form a tarpaulin-blanket unit, said unit being of rectangular shape and having four corners, a grommet at each of the corners of said tarpaulin-blanket unit for enabling said unit to be secured in place, a pair of securing straps, affixed to one edge of said tarpaulin-blanket unit at two spaced locations on one side of the midpoint of said one edge, for encircling the unit, when the unit is in a rolled-up state, so as to retain the unit in said rolled-up state, each of said securing straps having a free end and a base portion, and said securing straps each including releasable securing means for releasably securing the free end of said strap to an area on said unit at least close to said base portion, said securing strap comprising free ends of an elongate element having a central portion secured to said one edge; and a carrying handle, secured to said one edge of said unit between said straps, for enabling carrying of the unit in said rolled-up state.

10. A combination tarpaulin-blanket construction as claimed in claim 9 wherein said elongate element comprises a length of a synthetic webbing.

11. A combination tarpaulin-blanket construction as claimed in claim 10 wherein said carrying handle is fabricated from a synthetic webbing.

12. A combination tarpaulin-blanket construction as claimed in claim 9 wherein said releasable securing means comprises a snap-lock fastener arrangement comprising a first fastener element disposed at said free end and a second fastener element disposed at said area.

13. A combination tarpaulin-blanket construction as claimed in claim 9 wherein said straps each include adjustment means for adjusting the length thereof.

14. A combination tarpaulin-blanket construction as claimed in claim 9 wherein said carrying handle includes adjustment means for adjusting the length thereof.

15. A combination tarpaulin-blanket construction as claimed in claim 9 wherein said tarpaulin layer material comprises a cellulose acetate synthetic yarn.

16. A combination tarpaulin-blanket construction as claimed in claim 9, wherein said tarpaulin layer material comprises a cotton canvas.

17. A combination tarpaulin-blanket construction comprising:

a first, tarpaulin layer of a material selected from the group consisting of a cotton canvas, a cotton duck and a cellulose acetate synthetic yarn, said first layer covered by a protective covering of a waterproof and windproof laminated plastic, a second, blanket layer of synthetic fleece, said second layer being sewn to a major surface of the first layer to form a tarpaulin-blanket unit, said unit being of rectangular shape and having four corners, a grommet at each of the corners of said tarpaulin-blanket unit for enabling said unit to be secured in place, a pair of securing straps, affixed to one edge of said tarpaulin-blanket unit at two spaced locations on one side of the midpoint of said one edge, for encircling the unit, when the unit is in a rolled-up state, so as to retain the unit in said rolled-up state, each of said securing straps having a free end and a base portion, and said securing straps each including releasable securing means for releasably securing the free end of said strap to an area on said unit at least close to said base portion; and a carrying handle, secured to said one edge of said unit between said straps, for enabling carrying of the unit in said rolled-up state, said releasable securing means comprising a snap-lock fastener arrangement comprising a first fastener element disposed at said free end and a second fastener element disposed at said area, said straps each including adjustment means for adjusting the length thereof, and said carrying handle including adjustment means for adjusting the length thereof.

* * * * *